US012467676B2

(12) United States Patent
Ros

(10) Patent No.: US 12,467,676 B2
(45) Date of Patent: Nov. 11, 2025

(54) TRANSPORT CONTAINER

(71) Applicant: REP IP AG, Zug (CH)

(72) Inventor: Nico Ros, Riehen (CH)

(73) Assignee: REP IP AG, Zug (CH)

( * ) Notice: Subject to any disclaimer, the term of this patent is extended or adjusted under 35 U.S.C. 154(b) by 185 days.

(21) Appl. No.: 18/272,612

(22) PCT Filed: Jan. 13, 2022

(86) PCT No.: PCT/IB2022/050235
§ 371 (c)(1),
(2) Date: Jul. 17, 2023

(87) PCT Pub. No.: WO2022/153200
PCT Pub. Date: Jul. 21, 2022

(65) Prior Publication Data

US 2024/0077244 A1 Mar. 7, 2024

(30) Foreign Application Priority Data

Jan. 15, 2021 (AT) ..... A 9/2021

(51) Int. Cl.
*F25D 3/12* (2006.01)
*F25D 23/02* (2006.01)
*F25D 23/06* (2006.01)

(52) U.S. Cl.
CPC ..... *F25D 3/125* (2013.01); *F25D 23/025* (2013.01); *F25D 23/062* (2013.01);
(Continued)

(58) Field of Classification Search
CPC ..... F25D 3/125; F25D 23/025; F25D 23/062; F25D 2201/1282; F25D 2201/14; F25D 2303/0844; F25D 2303/00–2303/085
See application file for complete search history.

(56) References Cited

U.S. PATENT DOCUMENTS 9,395,116 B1 * 7/2016 Arnold ..... F25D 3/125
2004/0231355 A1 11/2004 Mayer
2014/0144161 A1 5/2014 Pointer et al.

FOREIGN PATENT DOCUMENTS

CN 106471321 A 3/2017
CN 106918178 A 7/2017
(Continued)

OTHER PUBLICATIONS

International Search Report and Written Opinion received in PCT/IB2022/050235 dated Apr. 12, 2022, pp. 14.
(Continued)

*Primary Examiner* — Cassey D Bauer
(74) *Attorney, Agent, or Firm* — Liang & Hennessey LLP; Brian Hennessey

(57) ABSTRACT

A transport container for transporting temperature-sensitive goods, having a container wall arrangement surrounding an interior chamber for accommodating the goods comprising a plurality of walls adjoining one another at an angle. The container wall arrangement has an opening for loading and unloading the interior chamber, which opening can be closed by means of a door device, and the container wall arrangement encloses the interior chamber on all sides with the exception of the opening. The container wall arrangement consists of a layered structure comprising, from the outside to the inside, a first insulation layer, optionally a second insulation layer, and an energy distribution layer bounding the interior chamber and made of a material having a thermal conductivity of >100 W/(m·K). In the interior chamber, at least one coolant reservoir for holding a coolant is arranged and/or fastened to at least one wall, in particular an upper wall.

20 Claims, 5 Drawing Sheets

(52) U.S. Cl.
CPC .. *F25D 2201/1282* (2013.01); *F25D 2201/14* (2013.01); *F25D 2303/0844* (2013.01)

(56) References Cited

FOREIGN PATENT DOCUMENTS

| | | | |
|---|---|---|---|
| CN | 107850379 | A | 3/2018 |
| CN | 109716042 | A | 5/2019 |
| EP | 3128266 | A1 | 2/2017 |
| KR | 102145989 | B1 | 8/2020 |
| WO | 9424498 | A1 | 10/1994 |
| WO | 2017072508 | A1 | 5/2017 |
| WO | 2020161572 | A1 | 8/2020 |

OTHER PUBLICATIONS

Chinese Office Action received in 202280010157.5 dated Aug. 15, 2025, pp. 1-10.

* cited by examiner

TRANSPORT CONTAINER

CROSS-REFERENCE TO RELATED APPLICATIONS

The present application is a national phase application of PCT Application No. PCT/IB2022/050235, filed Jan. 13, 2022, entitled "TRANSPORT CONTAINER", which claims the benefit of Austrian Patent Application No. A9/2021, filed Jan. 15, 2021, each of which is incorporated by reference in its entirety.

BACKGROUND OF THE INVENTION

1. Field of the Invention

The invention relates to a transport container for transporting temperature-sensitive goods to be transported, having a container wall arrangement surrounding an interior chamber for receiving the goods to be transported. The transport container includes a plurality of walls adjoining one another at an angle. The container wall arrangement has an opening for loading and unloading the interior chamber, which opening can be closed by means of a door device. The container wall arrangement encloses the interior chamber on all sides with the exception of the opening.

2. Description of the Related Art

When transporting temperature-sensitive goods, such as pharmaceuticals, over periods of several days, specified temperature ranges must be maintained during storage and transport in order to ensure the usability and safety of the goods being transported. Temperature ranges of −60° C. to −80° C. are specified as storage and transport conditions for various drugs and vaccines.

To ensure that the desired temperature range of the transported goods is permanently and verifiably maintained during transport, transport containers, e.g. air freight containers, with special insulation properties are used. The technical implementation of transport containers for the temperature range −60° C. to −80° C. is usually carried out with insulated containers in combination with a coolant. For insulation, layered wall constructions of standard insulation material such as EPS, PIR or XPS as well as high-performance insulation such as vacuum panels (VIP) are used.

Dry ice (solid $CO_2$) is used as a coolant, which is ideal for this temperature range due to the sublimation temperature of approx. −78.5° C. In addition, an amount of energy of 571.1 kJ/kg is required for the phase transition from solid to gas (sublimation), which enables a very large cooling effect at low weight compared to commercially available phase change material in a similar temperature range (2200 kJ/kg). Another advantage of dry ice is its residue-free dissolution. The only thing that has to be ensured is a safe outflow of the gaseous carbon dioxide, which at normal pressure and a temperature of 0° C. takes up about 760 times the volume of the dry ice. For air transport, there are usually maximum sublimation rates or dry ice quantities per flight which must not be exceeded. Minimizing the amount of dry ice used per kg of cargo therefore directly affects the total amount of cargo allowed per flight.

There are different approaches for positioning the dry ice inside the transport container. In one variant, the dry ice is placed on or inside the transported goods. The advantage of this procedure is that the temperature of the goods is very constant at about −78° C. One disadvantage is that a large amount of dry ice must be used to achieve uniform coverage of the transported goods and fill the gaps. Another disadvantage is that the amount of dry ice required depends on the goods being transported and the packaging. In addition, the transit time of the transport container is limited by a local temperature deviation in the case of asymmetric heat input. The rest of the dry ice effectively goes unused.

In another variant, the dry ice is placed in disc form around the goods on all sides and at the top and bottom of the transport container. The advantage here is also the uniform temperature distribution. However, if an asymmetric heat input occurs (e.g., due to solar radiation from above), the transit time of the entire transport container is also limited here by the point at which the dry ice first sublimates completely. On the sides with lower heat input, part of the dry ice remains unused. Nevertheless, in order to achieve the desired runtime, a large amount of dry ice is required, with only a certain amount effectively needed. Furthermore, with regard to manual handling, it is time-consuming to introduce the dry ice on all sides, as well as at the top and bottom of the transport container, before each transport. In addition, it is not readily possible to extend the service life of the transport container by replacing the dry ice, as this requires the container to be completely disassembled.

Another problem with the use of dry ice is that the inner walls of the transport container are usually made of plastic or cardboard, so that heat distribution in the interior chamber takes place only through the transported goods themselves and via natural convection in the interior chamber. The heat flow over the transported goods is given by the average thermal conductivity of the goods and the packaging and cannot be guaranteed. The transported goods must therefore have a certain distance to the side walls, the rear wall and the floor, so that air circulation is not impeded and an even temperature distribution can be achieved by natural convection. This has the disadvantage that not all of the interior chamber can be used for the transported goods.

SUMMARY OF THE INVENTION

The present invention is intended to provide a transport container for the temperature range −60° C. to −80° C., which has the following properties. The dry ice introduced should be used as efficiently as possible. This means that at the end of the runtime, which is defined by the time of the first temperature deviation above −60° C. in the interior chamber, as large a proportion as possible of the dry ice should have sublimed. Due to the limitations on the amount of dry ice allowed in air transport, this is critical to the total amount of cargo that can be transported per flight.

It should also be possible to use the entire interior chamber of the transport container for the goods to be transported. No gaps or shafts should be required for air circulation. Placing the dry ice in the transport container before transport should be as simple as possible. After transport, it should also be possible to extend the runtime by renewing the dry ice without having to disassemble the transport container or remove the transported goods.

The structure and the materials used should be able to withstand the low temperatures, absorb the mechanical forces due to thermal stresses and loads during transport, and at the same time be as light as possible.

To solve this problem, the invention essentially provides, in a transport container of the type mentioned at the beginning, that the container wall arrangement consists of a layered structure comprising, from the outside to the inside:

a first insulation layer, optionally a second insulation layer, and an energy distribution layer bounding the interior chamber and made of a material having a thermal conductivity of >100 W/(m·K), and that at least one coolant reservoir for holding a coolant is arranged and/or fastened in the interior chamber on at least one wall, in particular an upper wall.

By combining a coolant reservoir for holding a coolant, such as dry ice, arranged and/or attached to at least one wall in the interior chamber with an energy distribution layer bounding the interior chamber, efficient heat distribution is achieved over the entire interior envelope so that the amount of coolant can be minimized Due to the heat distribution, it is sufficient here to arrange the coolant on only one wall. However, it is also conceivable to provide the coolant on two or more walls. The highly thermally conductive inner shell allows very efficient use of the dry ice, with heat inputs at any position of the transport container being conducted to the coolant and absorbed there, thus compensating for asymmetric heat input and avoiding one-sided sublimation of the dry ice. The coolant quantity can be selected in such a way that the coolant is almost completely used up at the end of the running time.

Preferably, the at least one coolant reservoir or its support is in direct thermally conductive contact with the energy distribution layer, the thermally conductive contact preferably having a thermal conductivity of >100 W/(m·K).

The energy distribution layer bounding the interior chamber is preferably in direct contact with the interior chamber, so that direct heat transfer between the interior chamber and the energy distribution layer is ensured.

Since convection is not required for heat distribution over the entire interior volume, the interior chamber can be used entirely for the payload. No air gaps or shafts are needed to maintain air circulation.

The highly efficient dry ice utilization by internal heat distribution in combination with a two-layer insulation of the container wall arrangement results in a running time of more than 100-140 h at an average outside temperature of 30° C. with a dry ice quantity of 80-120 kg and a payload volume of 1 to 1.5 $m^3$ with an outer volume of 2-4 $m^3$. Compared to conventional solutions, this is a significant improvement by a factor of 2 to 20. Thus, a payload volume of 1 to 1.5 $m^3$ per RKN aircraft position can be achieved or 4 transport containers can be arranged on a PMC pallet with a total payload volume of 4×1.5 $m^3$ or 6 $m^3$.

As far as the layered structure of the container wall arrangement is concerned, it is preferably provided that the first insulation layer, the second insulation layer, if present, and the energy distribution layer lie directly on top of each other.

Preferably, the first insulation layer, the second insulation layer (if present) and the energy distribution layer enclose the interior chamber on all sides and without interruption, with the exception of the opening. The energy distribution layer completely surrounds the interior chamber with the exception of the opening, i.e. each wall of the container wall arrangement comprises the energy distribution layer as the innermost layer, the energy distribution layers of all walls being thermally conductively connected to one another in the adjacent edges and corners, i.e. by means of a joint which has a thermal conductivity of >100 W/(m·K).

Preferably, the door device also consists of the layered structure used for the container wall arrangement. In particular, the door device consists of a layered structure comprising, from the outside to the inside: a first insulation layer, optionally a second insulation layer, and an energy distribution layer bounding the interior chamber and made of a material with a thermal conductivity of >100 W/(m·K).

For sufficient heat distribution, a thermal conductivity of the energy distribution layer of at least 100 W/(m·K) is specified. The higher the thermal conductivity of the energy distribution layer is selected, the more efficient is the utilization of the coolant. According to a preferred embodiment, it may be provided that the thermal conductivity of the energy distribution layer of the container wall arrangement and/or the door device is at least 140 W/(m·K), more preferably at least 180 W/(m·K). The energy distribution layer of the container wall arrangement and/or the door device can be made, for example, of aluminum, of graphite or of a graphite composite material, in particular graphite sheets coated on both sides with carbon fiber-reinforced plastic. Such materials also result in mechanical reinforcement of the container wall arrangement at low weight.

In the case of aluminum, 0.5-5 mm thick aluminum plates can be used, which have a thermal conductivity of about 150 W/(m·K), distributing local heat input over the inner shell and creating a uniform temperature distribution in the interior chamber. The joints of the individual aluminum plates on the sides and corners may be reinforced with rivets so that they can withstand the forces generated by thermal stresses.

In the case of the carbon graphite composite sheet energy distribution layer design, for example, composite sheets may consist of a 0.2-1 mm thick graphite core laminated on both sides with 0.2-2 mm thick sheets of carbon fiber reinforced plastic (CFRP). Since graphite exhibits thermal conductivities of up to 400 W/(m·K) depending on density, similar or higher average thermal conductivities can be achieved with carbon graphite composite panels than with comparable aluminum panels. In addition, CFRP has a better mechanical strength-to-weight ratio than aluminum, which enables weight savings. Another advantage of carbon graphite composite sheets is the low coefficient of thermal expansion of CFRP. Typical values in the fiber direction are $\alpha_{CFK}=0.6\cdot10^{-6}\ K^{-1}$. For comparison, the coefficient of thermal expansion of a common aluminum alloy: $\alpha_{EN\text{-}AW\ 5754}=23.8\cdot10^{-6}\ K^{-1}$. This reduces thermal stresses and the resulting mechanical loads on the inner shell.

In a particularly preferred manner, the at least one coolant reservoir is designed as a drawer which is guided in a drawer guide so that it can be extracted from the interior chamber and inserted into the interior chamber. Such a design allows extremely simple handling, in which the coolant can be filled or renewed without having to disassemble the transport container or remove the transported material. The running time of the transport container can be extended as required by refilling the coolant.

Preferably, the drawer(s) has/have such dimensions that the entire surface of one wall of the container wall arrangement is covered.

Preferably, the at least one coolant reservoir, in particular the drawer(s) as well as the drawer guide, which is attached to at least one wall, is also made of a highly heat-conductive material so that the heat introduced is distributed evenly over the coolant. Here, it is preferably provided that the at least one coolant reservoir is made of a material with a thermal conductivity of >100 W/(m·K), preferably >140 W/(m·K), in particular >180 W/(m·K), for example aluminum, graphite or a graphite composite material, in particular graphite sheets coated on both sides with carbon fiber-reinforced plastic.

Thermal insulation of the transport container is achieved by a first and, if necessary, a second insulation layer. The structure of the container wall arrangement with at least two insulation layers allows each insulation layer to be optimized with regard to its respective insulation function. Preferably, one of the insulation layers, in particular the first, outer insulation layer, is designed to minimize the heat transfer to the interior chamber that occurs via thermal radiation. The other insulation layer, in particular the second, inner insulation layer, may be formed to minimize heat transfer to the interior chamber that occurs via solid-state heat conduction.

Preferably, the first insulation layer may have a thermal conductivity of 4 to 300 mW/(m·K) and the second insulation layer may have a thermal conductivity of 1 to 30 mW/(m·K), with the first insulation layer preferably having a higher thermal conductivity than the second insulation layer.

This can result in a U-value for the transport container of 0.1-0.2 $W/m^2K$, which corresponds to a very low heat input compared to transport containers commonly used in the industry.

With respect to the design of one of the insulation layers, preferably the first insulation layer, as a barrier against thermal radiation, it may comprise a heat-reflective coated carrier material, such as a carrier material provided with a metal coating. Preferably, the heat-reflecting coating is formed by a metallic, in particular gas-tight coating, preferably a coating with an emissivity of <0.5, preferably <0.2, particularly preferably <0.04, such as a coating of aluminum. Preferably, it is provided that said insulation layer comprises a multilayer structure of honeycomb-shaped thermoformed plastic films, which is provided on both sides with a heat-reflective coating, in particular of aluminum. An advantageous design results if said insulation layer has a plurality of, in particular, honeycomb-shaped hollow chambers, a honeycomb structural element according to WO 2011/032299 A1 being particularly advantageous. Alternatively, said insulation layer may be made of a conventional porous insulation material, such as polyurethane, polyisocyanurate or expanded polystyrene. The insulation layer preferably has a thickness of 60-80 mm.

With regard to the design of the other insulation layer, preferably the second insulation layer, as a barrier against solid-state heat conduction, it may preferably be designed as vacuum thermal insulation and preferably comprise or consist of vacuum insulation panels.

The second insulation layer preferably has a thickness of 30-50 mm.

Preferably, the vacuum insulation panels have a porous core material as a support body for the vacuum present inside and a gas-tight envelope surrounding the core material, the core material preferably consisting of an aerogel, open-pore polyurethane or open-pore polyisocyanurate. The advantage of these core materials over conventional fumed silica is their lower density, which can result in weight savings over conventional vacuum panels. The density of aerogel, for example, is in the range 80-140 $kg/m^3$, whereas fumed silica usually has a density of 160-240 $kg/m^3$. This with similar thermal conductivity properties in the range 2-6 mW/(m·K).

Alternatively, the latter insulation layer may have an outer wall, an inner wall spaced therefrom, and a vacuum chamber formed between the outer and inner walls, the vacuum chamber being in the form of a continuous vacuum chamber surrounding the interior chamber on all sides except for the opening. This insulation layer of the container wall arrangement is thus designed as a double-walled vacuum container, which surrounds the interior chamber on all sides with the exception of the container opening. Therefore, unlike the use of conventional vacuum panels, the insulation does not consist of individual vacuum elements that have to be assembled into an envelope, but includes in one part all sides of the transport container except for the opening. Since a continuous vacuum chamber is formed between the inner and outer walls of the insulation layer, surrounding the interior chamber on all sides except for the opening, joints between the separate vacuum panels that would otherwise be required and the associated thermal bridges can be avoided. The double-walled design of the insulation layer is also self-supporting, so in addition to insulation it also has a stabilizing function. This means that load-bearing structural parts can be saved.

The term "vacuum chamber" means that the space between the inner and outer walls of the insulation layer is evacuated, thereby achieving thermal insulation by reducing or eliminating the heat conduction of the gas molecules through the vacuum. Preferably, the air pressure in the vacuum chamber is 0.001-0.1 mbar.

Preferably, the outer and inner walls are made of a metal sheet, in particular stainless steel, aluminum or titanium, and preferably have a thickness of 0.01 to 1 mm. This ensures the required stability on the one hand and the gas-tight design of the walls on the other. In such an embodiment, the inner wall of the insulation layer, when arranged as the second insulation layer, may simultaneously form the energy distribution layer.

In order to be able to withstand the compressive forces of the surrounding air without having to make the outer and inner walls excessively thick, the outer wall and the inner wall are preferably connected by a plurality of spacers, which are preferably made of a synthetic material with a thermal conductivity of <0.35 W/(m-K), such as polyetheretherketone or aramid. The spacers ensure the desired distance between the outer and inner walls so that the intervening cavity, i.e. the vacuum chamber, remains. Since the spacers form thermal bridges, it is advantageous to make them from a material with the lowest possible thermal conductivity.

In order to further increase the thermal insulation performance of the insulation layer, a preferred further development provides that a plurality of spaced-apart insulation foils are arranged in the vacuum chamber, the film plane of which is substantially parallel to the plane of the outer and inner walls. In particular, the insulating foils are in stacked form, preferably with a stack of foils arranged in each wall of the container wall arrangement and extending substantially across the entire wall. Preferably, the insulation foils are arranged so that they surround the interior chamber on all sides except for the opening.

Preferably, the insulation foils are arranged in such a way that a gap (protective space) remains between the inner surface of the outer or inner wall facing the vacuum chamber and the foil stack in each case, so that the foil stack is not compressed by any deformation of the walls. In addition, the distance provides space for constructive stabilization of the spacers and facilitates vacuuming.

A further preferred design provides that the insulating foils are held at a distance from one another by flat spacer elements, the flat spacer elements preferably being formed by a textile sheet material, in particular in the form of a polyester nonwoven.

In particular, the insulation foils can be designed as metal-coated or -vaporized plastic foils. Such insulation foils are also called superinsulation foils. For example, the metal coating is made of aluminum.

The overall performance of the insulation of the transport container naturally depends also on the thermal insulation properties of the door device closing the opening of the interior chamber. As already mentioned, the door device can here consist of a layered structure corresponding to the layered structure of the container wall arrangement and comprising, from the outside to the inside, a first insulation layer, a second insulation layer and an energy distribution layer bounding the interior chamber and made of a material with a thermal conductivity of >100 W/(m·K).

In a particularly preferred embodiment, the door device includes at least one inner door panel and at least one outer door panel. In particular, the door panels are hinged doors attached to the transport container by means of a hinge. The formation of at least one outer door panel and at least one inner door panel gives rise to a two-layer construction, in which the at least one outer door panel preferably forms the first insulation layer of the door device and the at least one inner door panel forms the second insulation layer of the door device, reference being made to the functions and properties described above in connection with the insulation layers of the container wall arrangement with respect to the properties and construction of the first and second insulation layers.

The at least one outer door panel and the at least one inner door panel can preferably be opened and closed separately and independently of each other. The double-walled construction of the door device results in a temperature around 0° C. (between −20° C. and 8° C.) on the outside of the at least one inner door panel when the interior temperature is −60° C. to −80° C. This makes it possible to open the inner door panel by hand (i.e. without the risk of cold burns) during operation. Preferably, this effect is achieved by the at least one inner door panel having a higher insulating performance (1 to 30 mW/(m·K)) than the at least one outer door panel (4 to 300 mW/(m·K)).

In a preferred embodiment, the door device includes a single outer door panel and two inner door panels to form an inner double door.

The structure of the door device consisting of at least one outer and at least one inner door panel further allows the coolant to be renewed in the closed state of the at least one inner door panel, i.e. to be refilled into the coolant reservoir. For this purpose, it is preferably provided that the at least one inner door panel is arranged to keep the coolant reservoir accessible via the opened outer door panel when the at least one inner door panel is closed.

In this embodiment, the inner door panel or inner double door can be made smaller, for example, so that the coolant reservoir(s) can be opened when the inner door is closed. In the case of the design of the coolant reservoir as a drawer, it can be pulled out of its holder when the inner door is closed. This has the advantage that the running time of the transport container can be extended as required by renewing the coolant. In this case, the inner double door does not have to be opened and the transported goods do not have to be taken out.

From a constructional point of view, the at least one coolant reservoir can be kept accessible when the inner door panel is closed by the coolant reservoir having an access portion arranged in the opening of the container wall arrangement and by the at least one inner door panel cooperating with the access portion on the side facing the access portion in its closed state to sealably close off the interior chamber. For example, the design may be such that the inner door panel is substantially flush with a front face of the access portion. In this context, the access portion is the section or side of the coolant reservoir through which the coolant reservoir must be accessible for refilling the coolant. In the case of a drawer, for example, it is the drawer front that is gripped to pull the drawer out of the interior chamber of the transport container.

In order to ensure optimum thermal insulation in the area of the access portion, it is preferably provided that the coolant reservoir has vacuum thermal insulation on the front side facing the opening of the container wall arrangement.

When transporting transport containers by air, transport containers must allow for pressure equalization between the interior of the transport container and the pressurized cabin of the aircraft, especially since the cabin pressure prevailing in the passenger cabin and cargo hold is set lower than this corresponds to the ambient air pressure during takeoff and landing. For pressure equalization, transport containers are usually equipped with a valve or door seal that allows air to flow out of the container chamber to the outside (during climb) or from the outside into the container chamber (during descent) when a predetermined differential pressure between the environment and the container chamber is exceeded. In the latter case, however, warm ambient air enters the interior chamber of the container with the air flow, which has a significantly colder temperature compared to the surroundings, so that the temperature can fall below the dew point and water can condense from the air. The occurrence of condensate in the container chamber is undesirable because it affects the transported material.

In order to prevent condensation in the interior chamber of the transport container, it is preferably provided that at least one inner circumferential seal is provided between the at least one inner door panel and the opening of the container wall arrangement and at least one outer circumferential seal is provided between the at least one outer door panel and the opening of the container wall arrangement, and that a buffer space is arranged between the at least one inner door panel and the at least one outer door panel. This measure is based on the idea of cooling the air entering from the environment due to pressure equalization before it enters the interior chamber of the transport container. For this purpose, a buffer space is created, which is formed between the outer and inner circumferential seals and into which the ambient air flows before it enters the interior chamber, if necessary. The double-walled door structure consisting of an inner and outer door panel, together with the internal temperature of −60 to −80° C. as described above, ensures that a temperature of around 0° C. prevails on the outside of the inner door panel, so that the buffer space formed in the gap between the outer and inner door panels is cooled. Due to the pre-cooling of the ambient air in the buffer space, drying also takes place, with any condensate occurring along the flow path of the air upstream of the interior chamber and in particular in the buffer space, but in any case not in the interior chamber itself.

At the same time, it should be taken into account that in the case of dry ice, the consumption of the same produces $CO_2$ gas, which should escape from the interior chamber. The inner and outer seals therefore preferably each comprise at least one sealing element which can be displaced by pressure difference and which opens a gas passage from the inside to the outside when a predetermined pressure difference is exceeded.

The generation of $CO_2$ gas in the interior chamber can also compensate for pressure equalization during descent, where there would otherwise be a flow of air from the outside into the container chamber (during descent). This further reduces the risk of air infiltration including humidity compared to using a non-sublimating coolant.

The inner circumferential seal can be designed in such a way that it allows the $CO_2$ gas produced to escape, but at the same time largely prevents warm ambient air from flowing in. Together with the outer circumferential seal, this creates a labyrinth which, on the one hand, allows the $CO_2$ gas produced to escape and, on the other hand, ensures that the moisture of incoming air condenses on the outside of the at least one inner door panel, which has a temperature around 0° C. (between −20° C. and 8° C.). This prevents the penetration of humidity into the interior chamber and the associated formation of ice.

A preferred design of the thermal insulation provides that the at least one inner door panel comprises an inner aluminum shell and an outer aluminum shell and that a vacuum thermal insulation, preferably vacuum insulation panels, is or are arranged between the inner and outer aluminum shells for their thermal decoupling. For example, 30-50 mm thick vacuum insulation panels can be used. The inner and outer aluminum shells can be held together with fasteners made of low-heat-conducting, cold-resistant plastic (e.g. PEEK).

The outer door panel can be insulated with a 60-80 mm thick multi-layered structure of honeycomb deep-drawn PET foils coated on both sides with aluminum.

The insulation of the outer door panel can be further improved by inserting additional vacuum panels or partially replacing the existing insulation with vacuum panels. This reduces the heat input through the outer door panel and therefore has a beneficial effect on the running time of the transport container.

The transport container or container wall arrangement may be of various geometric shapes, in which a plurality of walls adjacent to each other at an angle are provided. Preferably, the container is a cuboid transport container having six walls, of which the container wall arrangement forms five walls and the door device forms the sixth wall.

The transport container according to the invention is preferably designed as an air freight container and therefore preferably has external dimensions of at least 0.4×0.4×0.4 m, preferably 0.4×0.4×0.4 m to 1.6×1.6×1.6 m, preferably 1.0×1.0×1.0 m to 1.6×1.6×1.6 m.

The first insulation layer of the container wall arrangement preferably forms the outer surface of the transport container, so that no other layers or elements are attached to the outer wall. Alternatively, another thermal insulation layer can be arranged on the outside of the first insulation layer, or a layer that protects the transport container from mechanical impact and damage.

Dry ice is the preferred coolant. However, other phase change materials are also possible. Common phase change materials based on kerosene or salt hydrate or other high enthalpy materials are suitable as coolants. The target temperature that can be achieved in the interior chamber of the transport container depends on the selection of the coolant and is not limited to specific temperature ranges within the scope of the present invention. The transport container can therefore be operated not only in a range from −60 to −80° C., but also, for example, in a range from −25 to −15° C.

In order to be able to detect any damage to the transport container, it is preferably provided that at least one temperature sensor is arranged in the interior chamber, and preferably at least one temperature sensor on each side of the transport container. Based on the measured values of the at least one temperature sensor, the performance of the insulation can be continuously monitored. In addition, a sensor can be fitted which measures the ambient temperature, whereby the insulation performance of the container wall arrangement can be continuously calculated from the temperature difference curve of the at least one temperature sensor arranged in the interior chamber and the external temperature sensor. This data can be continuously transmitted to a central database using wireless data transmission means, so that the functionality of the transport container can be globally monitored and ensured.

BRIEF DESCRIPTION OF THE DRAWINGS

The invention is explained in more detail below with reference to schematic examples of embodiments shown in the drawings.

DETAILED DESCRIPTION

Figure 1:
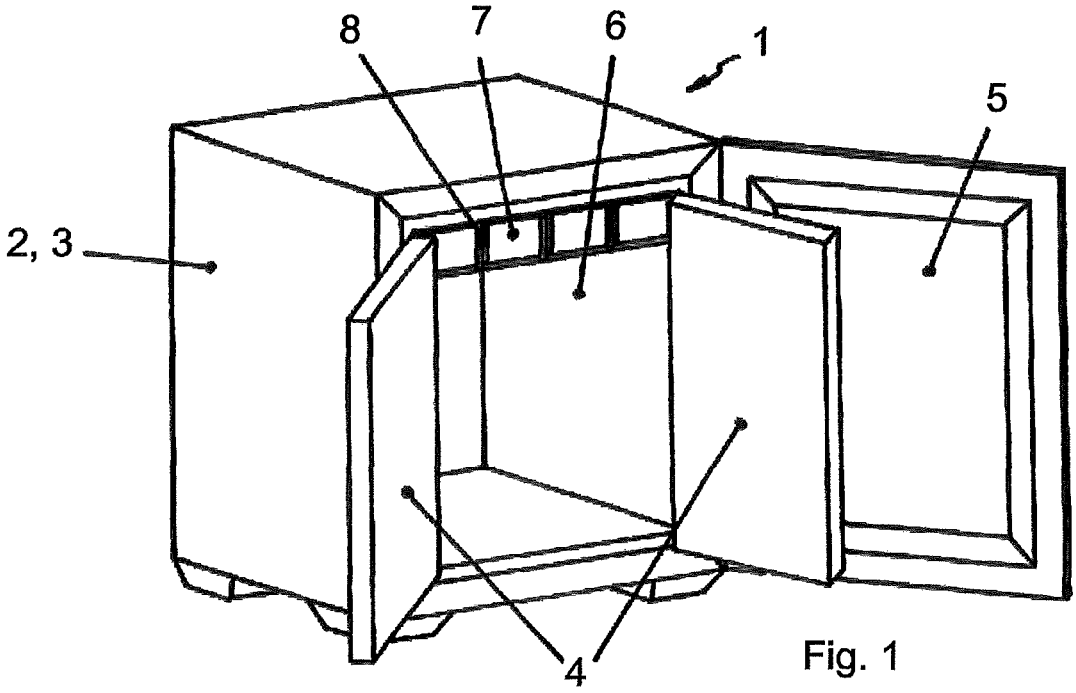
FIG. 1 shows a perspective view of a cuboid transport container according to the invention.

FIG. 1 shows a cuboid transport container 1 whose container wall arrangement surrounds an interior chamber on all sides except for an opening. The container wall arrangement includes two side walls, a back wall, a bottom and a ceiling.

The container wall arrangement consists of a multilayer insulation 2 and 3, an inner double door 4, an outer door 5, an energy distribution layer 6 forming the inner shell, drawers 7 with dry ice and a drawer guide 8, which are attached to the energy distribution layer 6 of the ceiling.

Figure 2:
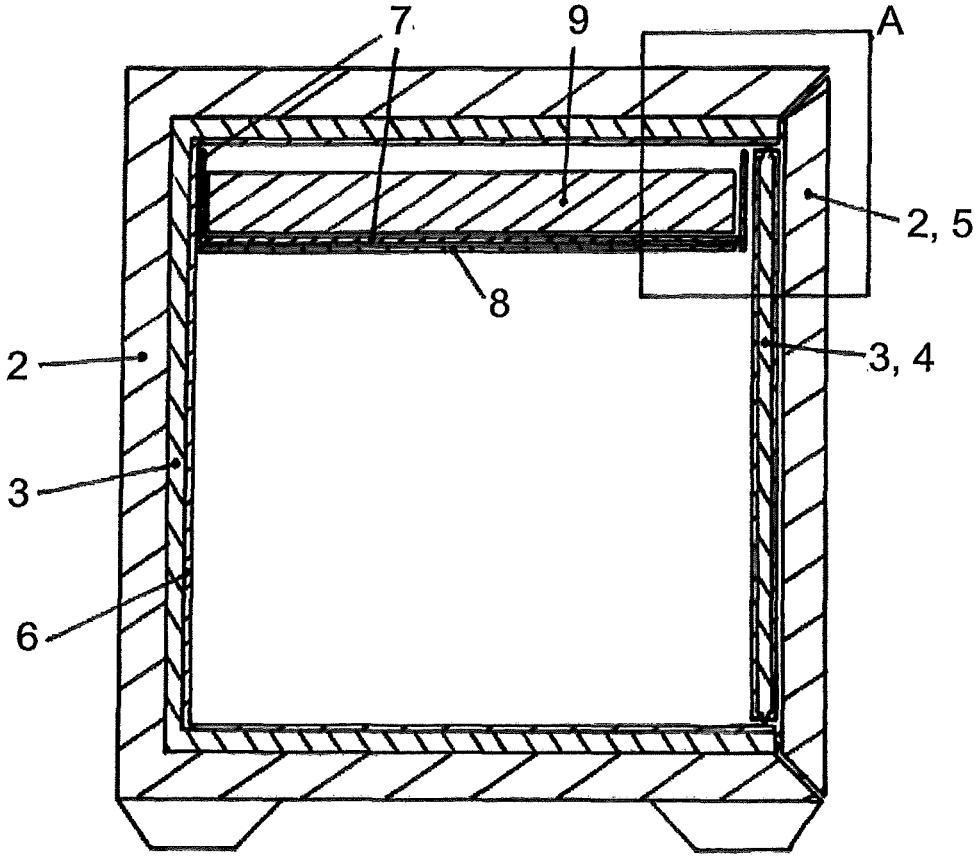
FIG. 2 shows a longitudinal section of the transport container according to FIG. 1 with closed doors and filled coolant drawers.

As can be seen in the sectional view according to FIG. 2, the insulation consists of an outer, first insulation layer 2 and an inner, second insulation layer 3. The first insulation layer is, for example, 60-80 mm thick and consists of a multilayer structure of honeycomb deep-drawn PET foils coated on both sides with aluminum. As a result, an insulating performance of the first insulation layer of 4 to 300 mW/(m·K) is achieved. The second insulation layer 3 is 30-50 mm thick and consists of a high-performance insulation, such as vacuum insulation panels (VIP) or aerogel, achieving an insulation performance of 1 to 30 mW/(m·K).

Figure 3:
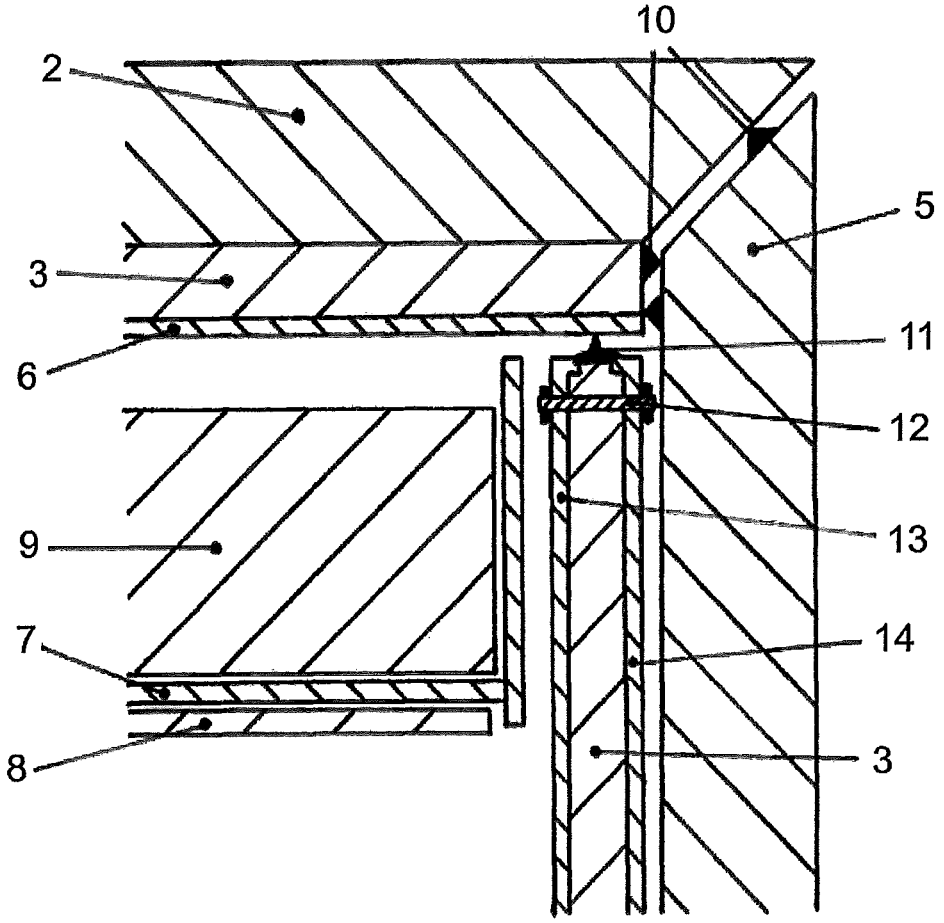
FIG. 3 shows a detailed view in area A of FIG. 2 of the door device of a first embodiment.

In the area of the front opening of the transport container, the inner double door 4 can be attributed to the inner, second insulation layer 3 and the outer door 5 to the outer, first insulation layer 2. As shown in FIG. 3, the inner double door 4 consists in each case of an inner 13 and an outer aluminum half-shell 14, with the inner and outer shells being thermally decoupled. Decoupling is achieved with inner insulation 3 consisting of 30-50 mm thick high-performance insulation, such as vacuum panels, and connecting elements made of low-heat conducting, cold-resistant plastic 12 (e.g. PEEK). The outer door 5 is insulated with a 60-80 mm thick multi-layered structure of honeycomb deep-drawn PET foils coated on both sides with aluminum. The combination of high insulation performance of the inner double door 4 (1 to 30 mW/(m·K)) and medium insulation performance of the outer door 5 (4 to 300 mW/(m·K)) results in a temperature of around 0° C. (between −20° C. and 8° C.) on the outside of the inner double door 4 at a temperature of the interior chamber of −60° C. to −80° C. This makes it possible to open the inner double door 4 manually (without risk of cold burn) during operation.

At the edge of the inner door 4 there is a seal 11 which allows the $CO_2$ gas produced to escape, but at the same time largely prevents warm ambient air from flowing in. Seals 10 are also located on the outer door so that, together with the inner door seal 11, a labyrinth is created which, on the one hand, allows the $CO_2$ gas produced to escape and, on the other hand, ensures that the moisture of incoming air condenses on the outside of the inner double door 4, which has a temperature around 0° C. (between −20° C. and 8° C.). This prevents the penetration of humidity into the interior chamber and the associated formation of ice.

The energy distribution layer 6 consists of e.g. 0.5-5 mm thick aluminum plates. These have a thermal conductivity of about 150 W/(m·K), which distributes local heat inputs across the interior envelope and creates a uniform temperature distribution in the interior chamber. The joints of the individual aluminum plates on the sides and corners are reinforced with rivets so that they can withstand the forces generated by thermal stresses.

The drawers 7 as well as the drawer guides 8, which are attached to the upper side of the inner shell 6, are also made of 0.5-5 mm thick aluminum plates with a thermal conductivity of 150 W/(m·K). The dry ice 9 is introduced directly into the drawers.

Figure 4:
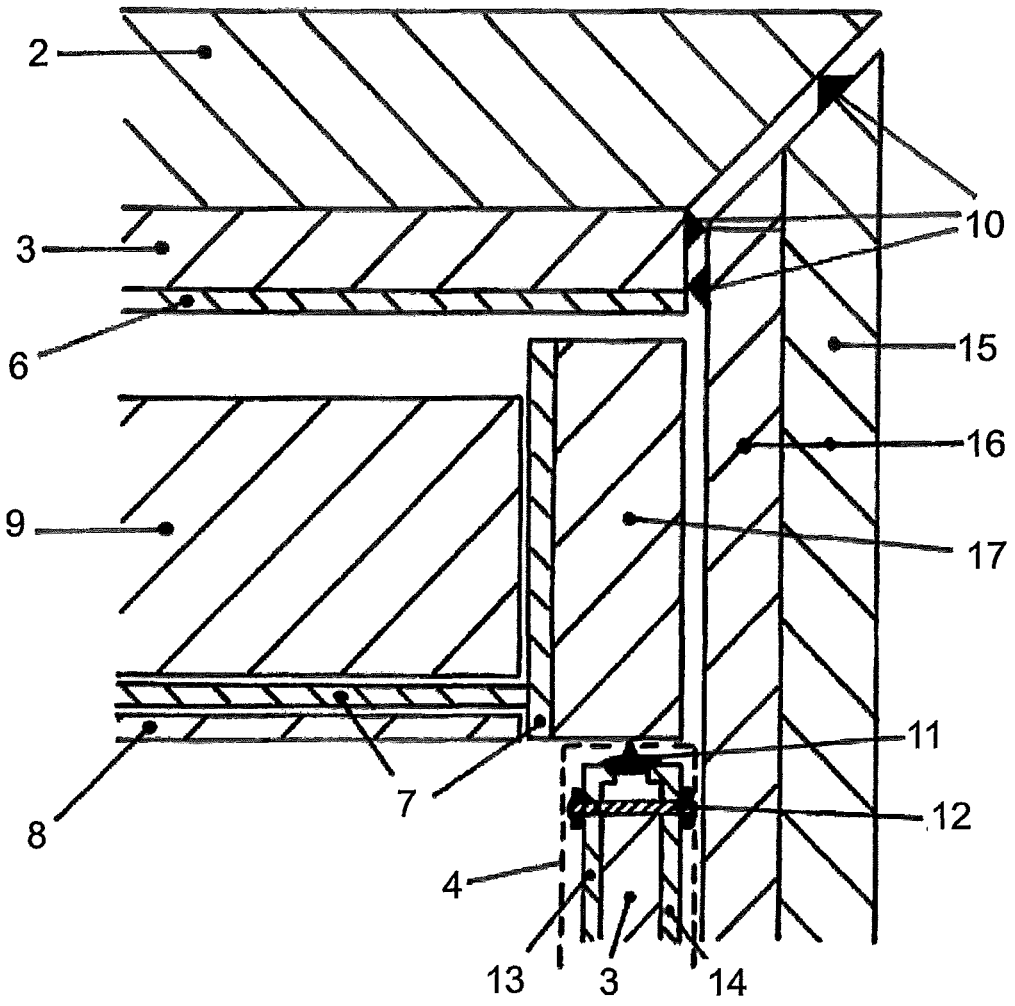
FIG. 4 shows a detailed view in the area of the door device of a second embodiment.
Figure 5:
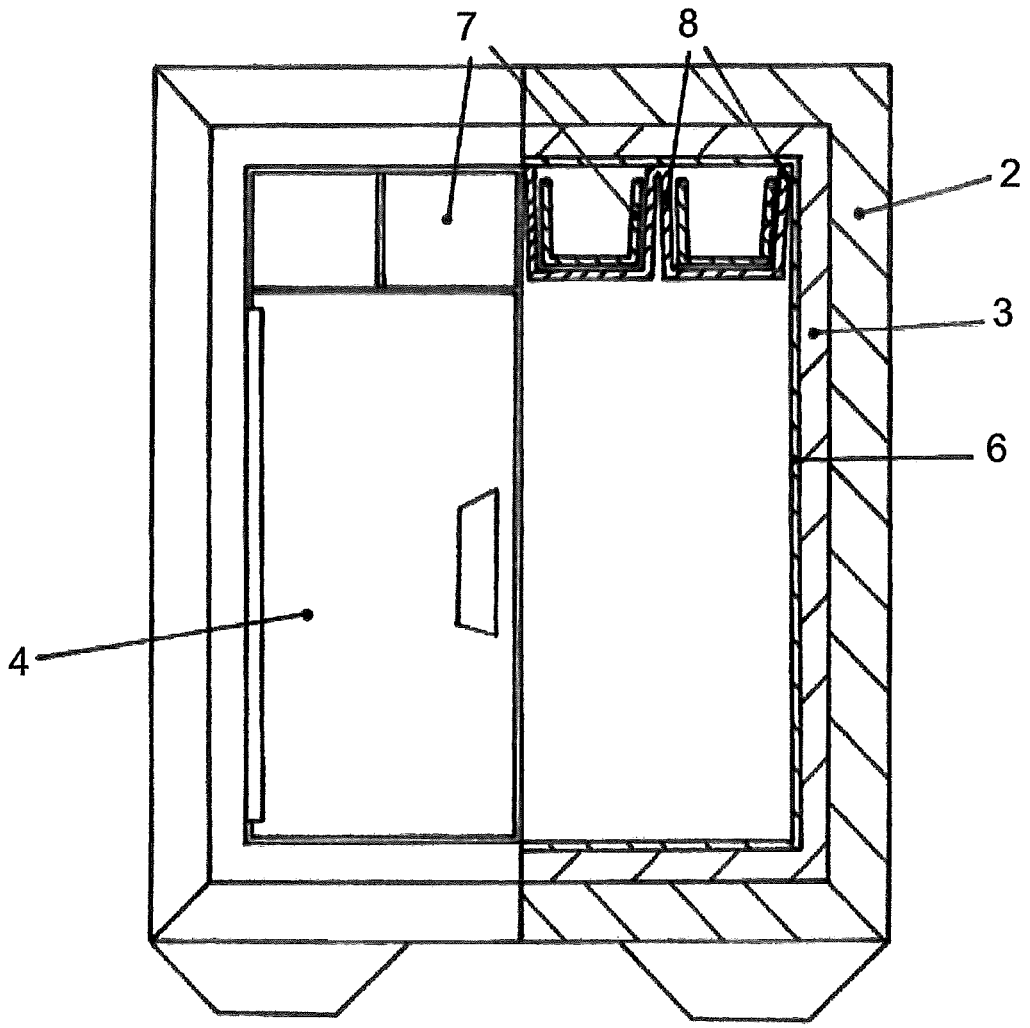
FIG. 5 shows a front view in partial section of the second embodiment.
Figure 6:
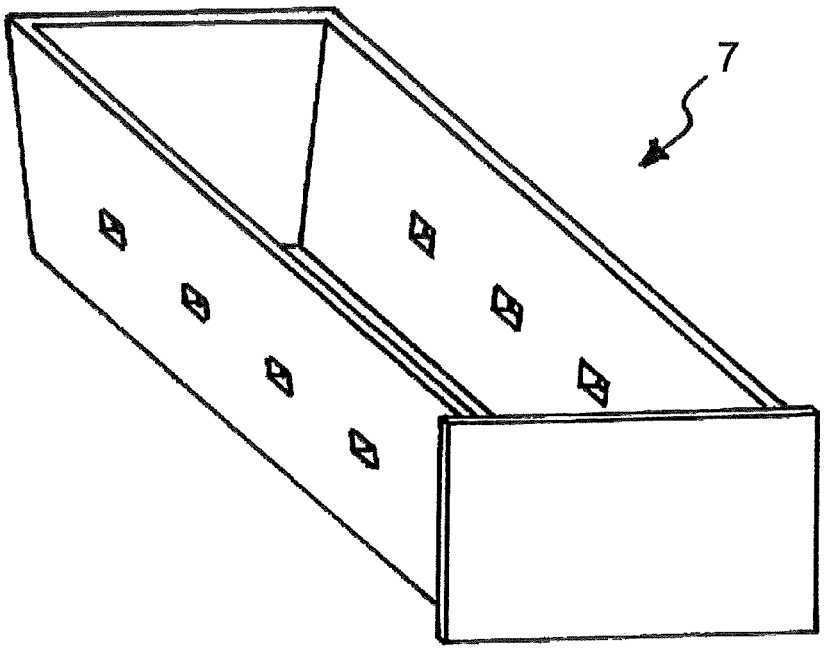
FIG. 6 shows a detailed view of a coolant drawer.

FIGS. 4 and 5 show a modified version, where in FIG. 5 the left half is a front view of the transport container with the inner double door 4 closed and the outer door 5 open, and the right half shows a cross-section through the transport container with drawers. In the modified version shown here, the inner double door 4 is made smaller so that the drawers 7 can be opened when the inner double door 4 is closed. In addition, the outside of the dry ice drawers 7 is insulated by 30-50 mm thick vacuum panels 17. This has the advantage that the running time of the transport container can be extended as required by renewing the dry ice. In this case, the inner double door does not have to be opened and the transported goods do not have to be taken out.

Furthermore, in this variant, the insulation of the outer door 5 is improved by inserting additional vacuum panels 16 or partially replacing the existing insulation 15 with vacuum panels. This reduces the heat input through the front door and therefore has a beneficial effect on the running time of the transport container.

The invention claimed is:

1. A transport container for transporting temperature-sensitive goods, comprising:

a container wall arrangement surrounding an interior chamber for receiving the goods, the container wall arrangement comprising a plurality of walls adjoining one another at an angle, the container wall arrangement having an opening for loading and unloading the interior chamber, and having a door device by means of which the opening can be closed, and the container wall arrangement enclosing the interior chamber on all sides except the opening, the container wall arrangement consisting of a layered structure comprising, from the outside to the inside a first insulation layer, and an energy distribution layer bounding the interior chamber and made of a material with a thermal conductivity of >100 W/(m·K), and in that at least one coolant reservoir for receiving a coolant is at least one of arranged and fastened in the interior chamber on at least one wall;

wherein the door device comprises at least one inner door panel and at least one outer door panel, and in that the at least one inner door panel is arranged to keep the coolant reservoir accessible via the opened outer door panel in the closed state of the at least one inner door panel; and wherein one of the at least one coolant reservoir and a support of the at least one coolant reservoir is directly in heat-conducting connection with the energy distribution layer.

2. The transport container according to claim 1, wherein the at least one coolant reservoir is at least one of arranged and fastened in the interior chamber on at least an upper wall.

3. The transport container according to claim 1, wherein the door device consists of a layered structure comprising from the outside to the inside:

a first insulation layer; and an energy distribution layer bounding the interior chamber and made of a material having a thermal conductivity of >100 W/(m·K).

4. The transport container according to claim 1, wherein the at least one coolant reservoir comprises a drawer guided in a drawer guide, the drawer extractable from the interior chamber and insertable into the interior chamber.

5. The transport container according to claim 1, wherein:

the first insulation layer has a thermal conductivity of 4 to 300 mW/(m·K); and a second insulation layer has a thermal conductivity of 1 to 30 mW/(m·K).

6. The transport container according to claim 5, wherein the first insulation layer has a higher thermal conductivity than the second insulation layer.

7. The transport container according to claim 1, wherein one of the first and a second insulation layer comprises a multilayer structure of honeycomb-shaped deep-drawn plastic foils, the multilayer structure being provided on both sides with a heat-reflecting coating.

8. The transport container according to claim 1, wherein one of the first and a second insulation layer comprises a vacuum thermal insulation.

9. The transport container according to claim 8, wherein the vacuum insulation panel comprises a porous core material as a support body for a vacuum present in the interior chamber and a gas-tight envelope surrounding the core material.

10. The transport container according to claim 1, wherein one of the first and a second insulation layer has an outer wall, an inner wall spaced therefrom and a vacuum chamber formed between the outer and inner walls, the vacuum chamber comprising a continuous vacuum chamber surrounding the interior chamber on all sides except the opening.

11. The transport container according to claim 10, wherein the outer wall and the inner wall are connected by a plurality of spacers.

12. The transport container according to claim 10, wherein the inner wall forms the energy distribution layer.

13. The transport container according to claim 1, wherein the energy distribution layer consists of one of aluminum, graphite, and a graphite composite material.

14. The transport container according to claim 1, wherein the at least one coolant reservoir consists of a material with a thermal conductivity of >100 W/(m·K).

15. The transport container according to claim 1, wherein:

the at least one outer door panel forms a first door insulation layer of the door device; and the at least one inner door panel forms a second door insulation layer of the door device.

16. The transport container according to claim 1, wherein:

the coolant reservoir comprises an access portion arranged in the opening; and the at least one inner door panel in a closed state cooperates with the access portion on a side facing the access portion to sealingly close off the interior chamber.

17. The transport container according to claim 1, further comprising:

at least one inner circumferential seal between the at least one inner door panel and the opening;

at least one outer circumferential seal between the at least one outer door panel and the opening; and a buffer space arranged between the at least one inner door panel and the at least one outer door panel.

18. The transport container according to claim 17, wherein:

the at least one inner circumferential seal comprises at least one inner sealing element displaceable by pressure difference adapted to open a gas passage from an inside to the buffer space when a predetermined pressure difference is exceeded; and the at least one outer circumferential seal comprises at least one outer sealing element displaceable by pressure difference adapted to open a further gas passage from the buffer space to an outside when the predetermined pressure difference is exceeded.

19. The transport container according to claim 1, wherein the at least one inner door panel comprises an inner aluminum shell and an outer aluminum shell, and a vacuum thermal insulation is arranged between the inner and outer aluminum shells for thermal decoupling thereof.

20. The transport container according to claim 1, wherein the coolant reservoir comprises a vacuum thermal insulation on a front side facing the opening of the container wall arrangement.

* * * * *